US005217206A

United States Patent [19]

Brosius et al.

[11] Patent Number: 5,217,206

[45] Date of Patent: Jun. 8, 1993

[54] VEHICLE JACK

[75] Inventors: Peter Brosius, Ayl; Willi Erschens, Waldweiler; Wolfgang Metzen, Kell, all of Fed. Rep. of Germany

[73] Assignee: August Bilstein GmbH & Co. KG, Ennepetal, Fed. Rep. of Germany

[21] Appl. No.: 933,997

[22] Filed: Aug. 21, 1992

[30] Foreign Application Priority Data

Aug. 22, 1991 [DE] Fed. Rep. of Germany ..... 4127739

[51] Int. Cl.[5] ..... B66F 3/12

[52] U.S. Cl. ..... 254/126; 254/DIG. 4

[58] Field of Search ..... 254/126, 101, DIG. 4, 254/133, 134, 122, 124

[56] References Cited

U.S. PATENT DOCUMENTS 3,259,367 7/1966 Squire ..... 254/101

5,011,118 4/1991 Brosius ..... 254/DIG. 4

*Primary Examiner*—Robert C. Watson

*Attorney, Agent, or Firm*—Max Fogiel

[57] ABSTRACT

A jack with a foot resting on the ground and with a supporting plate that rises away from the foot, lifts the vehicle, and pivots around one or more articulations on a supporting component around an axis paralleling the length of the vehicle. The object is to make it possible to compensate for tilting along the vehicle without causing unilateral stress that could damage the bottom of the vehicle with local pressure. The jack accordingly has at least one support (17) on or between the articulations (15 and 16) and between the supporting plate (8) and the supporting component (3), and the articulations allow a limited pitch paralleling the length of the vehicle on the part of the plate.

13 Claims, 2 Drawing Sheets

VEHICLE JACK

BACKGROUND OF THE INVENTION

Such a jack has a supporting plate that pivots across the length of the vehicle and into a well defined position under it independent of the jack's orientation toward the center of the vehicle and of how high the vehicle is lifted.

German 3 921 826 C1 discloses such a jack. It has a drawback in that the plate settles with one edge against the bottom of the vehicle when the jack's foot rests on a surface that is irregular along the vehicle or when the jack's gear shifts it forward or backward during the lifting process.

The object of the present invention is an enhanced version that will compensate for tilting paralleling the vehicle without generating unilateral stress that could locally damage the bottom of the vehicle.

The invention advantageously diminishes compulsory forces on the jack. It is nevertheless ensured that the jack will not twist beneath the vehicle. The jack will always remain flush with the vehicle. The invention will allow unexceptionable operation in spite of its economy and will ensure a maximal swing.

One embodiment of the invention is illustrated in the drawing and will now be specified.

DESCRIPTION OF THE PREFERRED EMBODIMENTS

Figure 1:
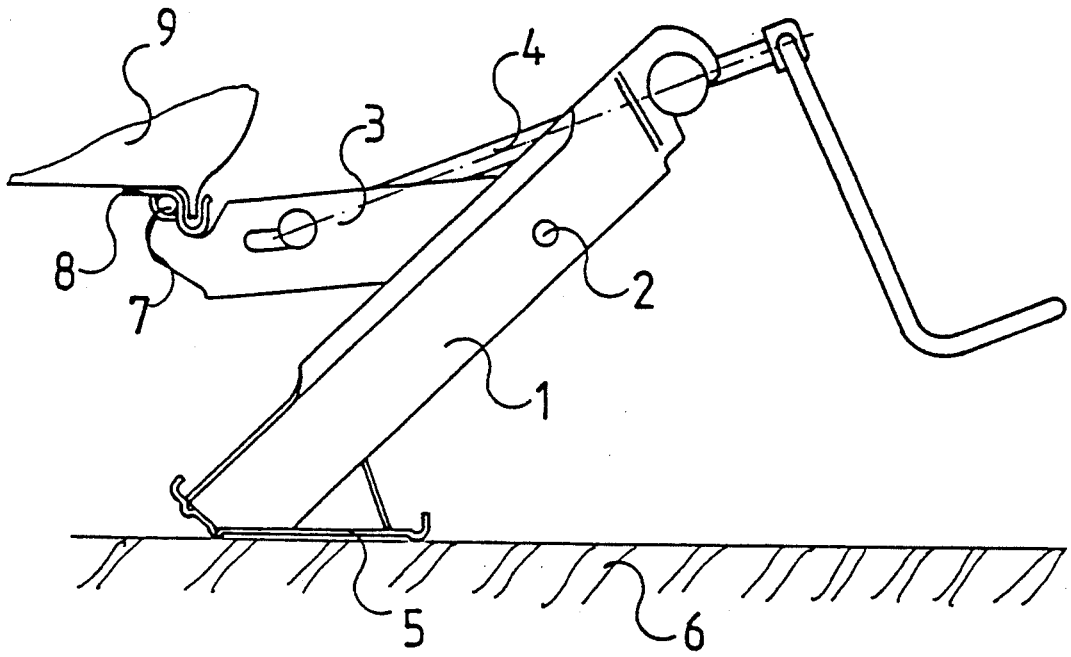
FIG. 1 is a schematic representation of a pivoting-arm jack.
Figure 2:
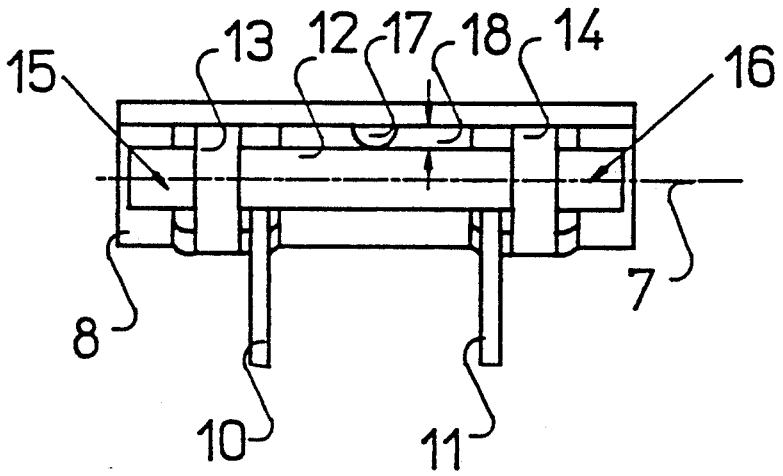
FIG. 2 is a view of the articulation of the plate to the supporting arm.
Figure 3:
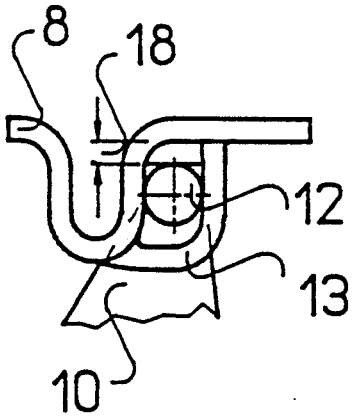
FIG. 3 is a side view of FIG. 2.

The pivoting-arm jack has a leg 1 and a supporting component 3 in the form of an arm that pivots on it around a point 2 of articulation. The supporting arm is raised on leg 1 by a threaded shaft 4. The leg rests against ground 6 on a foot 5. Pivoting on an axis 7 that extends along the vehicle on the free end of the supporting arm that constitutes supporting component 3 is a supporting plate 8 that is placed against the bottom of vehicle 9 and lifts it.

The free end of the supporting arm separates into two webs 10 and 11 attached to a supporting pin 12 that parallels axis 7. This axis itself extends along the vehicle. Supporting plate 8 has loops 13 and 14 that surround pin 12 and accordingly constitute two pivoting articulations 15 and 16. Loops 13 and 14 constitute a slot with its ends resting horizontally against pin 12 while allowing the plate to move vertically. Halfway between loops 13 and 14 is a support 17 in the form of a punched-out convexity between supporting plate 8 and pin 12 on the bottom of the plate and resting against pin 12. The convexity has an altitude 18 of approximately half the width of the slot in loops 13 and 14. This design allows supporting plate 8 to not only pivot on supporting component 3 across the length of the aforesaid but also to pitch to a limited extent along the vehicle. It is nevertheless ensured that the jack will not be able to twist in relation to the vehicle because pin 12 is definitely positioned horizontally in loops 13 and 14.

When specific demands are made on supporting component 3 with respect to limiting the pitch or to the transmission of forces from supporting plate 8 to the supporting component, one or more supports 17 can be distributed as needed between supporting plate 8 and pin 12. This embodiment is not illustrated.

Such other types of jack as heavy-duty and double-articulation jacks can be designed along similar principles. In that event the supporting component 3 can for example be the top of the jack.

List of parts

1. leg
2. point of articulation
3. supporting component
4. threaded shaft
5. foot
6. ground
7. axis
8. supporting plate
9. vehicle
10. web
11. web
12. pin
13. securing loop
14. securing loop
15. articulation
16. articulation
17. support
18. altitude of stamped-out convexity

We claim:

1. A jack for vehicles comprising: a foot resting on the ground; a supporting plate rising away from said foot for lifting a vehicle; a supporting member with at least one articulation, said supporting plate pivoting around said articulation and about an axis parallel to a longitudinal axis of the vehicle; at least one support element spaced from said articulation and between said supporting plate and said supporting member, said articulation allowing limited pitch motion of said supporting plate only along said longitudinal axis of the vehicle.

2. A jack as defined in claim 1, wherein said articulation comprises a supporting pin extending along said longitudinal axis of said vehicle; a securing loop surrounding said pin; said support element being located adjacent said pin.

3. A jack as defined in claim 1, wherein at least one articulation comprises two articulations; a pin extending along said longitudinal axis of said vehicle; two securing loops surrounding said pin and extending vertically in a slot.

4. A jack as defined in claim 1, wherein said support element is a stamped out element from said supporting plate and has a convex shape toward said supporting member.

5. A jack as defined in claim 3, wherein said support element is located substantially halfway between said two articulations.

6. A jack as defined in claim 3, wherein said support element is located between said two articulations.

7. A jack for vehicles comprising: a foot resting on the ground; a supporting plate rising away from said foot for lifting a vehicle; a supporting member with at least one articulation, said supporting plate pivoting around said articulation and about an axis parallel to a longitudinal axis of the vehicle; at least one support element on said articulation and between said supporting plate and said supporting member, said articulation allowing limited pitch motion of said supporting plate only along said longitudinal axis of the vehicle.

8. A jack as defined in claim 7, wherein said articulation comprises a supporting pin extending along said longitudinal axis of said vehicle; a securing loop surrounding said pin; said support element being located adjacent said pin.

9. A jack as defined in claim 7, wherein said at least one articulation comprises two articulations; a pin extending along said longitudinal axis of said vehicle; two securing loops surrounding said pin and extending vertically in a slot.

10. A jack as defined in claim 7, wherein said support element is a stamped out element from said supporting plate and has a convex shape toward said supporting member.

11. A jack as defined in claim 9, wherein said support element is located substantially halfway between said two articulations.

12. A jack as defined in claim 9, wherein said support element is located between said two articulations.

13. A jack for vehicles comprising: a foot resting on the ground; a supporting plate rising away from said foot for lifting a vehicle; a supporting member with at least one articulation, said supporting plate pivoting around said articulation and about an axis parallel to a longitudinal axis of the vehicle; at least one support element spaced from said articulation and between said supporting plate and said supporting member, said articulation allowing limited pitch motion of said supporting plate only along said longitudinal axis of the vehicle; said at least one articulation comprising two articulations; a pin extending along said longitudinal axis of said vehicle; two securing loops surrounding said pin and extending vertically in a slot; said support element being a stamp out element from said supporting plate and having a convex shape towards said supporting member; said support element being located substantially halfway between said two articulations.

* * * * *